US006105961A

United States Patent [19]

Price

[11] Patent Number: 6,105,961

[45] Date of Patent: Aug. 22, 2000

[54] DEFENSE ON FOOSBALL

[76] Inventor: Micheal L. Price, 4365 Avent Ferry Rd. Apt. 3, Raleigh, N.C. 27606

[21] Appl. No.: 09/201,211

[22] Filed: Nov. 30, 1998

[51] Int. Cl.[7] ..... A63F 7/06

[52] U.S. Cl. ..... 273/108.52; 273/126 A; 273/108.55

[58] Field of Search ..... 273/108.5–108.57, 273/129 S–129 W, 108.1, 126 A, 109–126 R

[56] References Cited

U.S. PATENT DOCUMENTS

| | | |
|---|---|---|
| 1,523,684 | 1/1925 | Canale . |
| 3,400,930 | 9/1968 | Leonhart . |
| 3,554,547 | 1/1971 | Vedeen . |
| 4,025,073 | 5/1977 | Furr . |
| 4,480,833 | 11/1984 | Barcelow . |
| 5,112,047 | 5/1992 | Monneret . |
| 5,297,792 | 3/1994 | Friedman . |

*Primary Examiner*—Sebastiano Passaniti
*Attorney, Agent, or Firm*—Robert M. Wolters

[57] ABSTRACT

A soccer board game of the type familiarly known as "foosball" has horizontal rods for operating the defense and offense manually. If a player wishes to practice the only option is to place all of the defensive rods in one position, and to leave them in that position while he plays the offensive. This is very unsatisfactory. I propose the electrical control of the defensive rods, so that the defensive set-up can be varied by presenting the offense with a myriad of defenses. This is accomplished by the use of an electric motor and a cam to set the defensive position. Alternatively, a rectangular wave is generated and applied to the defensive rods to change their position as wanted.

13 Claims, 2 Drawing Sheets

DEFENSE ON FOOSBALL

BACKGROUND OF THE INVENTION

Here is a game that is played on a special table at tabletop level. Although the game partakes more of soccer than it does of football, it is known popularly by the name of "foosball". The game is played usually with one player on each side, one playing the offensive, and the other playing the defensive. However, there can be more than one player on offense, and more than one player on defense.

The problem comes when one player alone is available. He must be able to play offense, but he may also may want to change the defense from time to time, just as in a normal game. The present device is used as a practice aid for table soccer. The device mounts on the table wall and connects to at least one of the five-man player rods. A DC motor and gearing package drive an arm that connects to the five-man rod, creating a reciprocating movement that simulates an opponent's push-pull defense. The defense is useful because it allows an individual to practice offensive strategy and passing all by himself, while adapting to changing defensive positions.

I have conducted a patentability search, and have found nothing along these lines. Similarly, many personal inquiries of those who play the game often have not produced any individual who has heard of such a defense.

OBJECTS AND SUMMARY OF THE PRESENT INVENTION

It is an object of the present invention to provide a foosball game which can be preset, or set as the game progresses by the defensive man, who is the same as the offensive player.

Variations include the ability to switch from one defensive position to another. They further include the opportunity of switching defenses while the game is in play, without detracting from the offensive player, but allowing him to choose the defenses.

THE DRAWINGS

The objects and advantages of the present invention will best be understood from a study of the following specification, while keeping the accompanying drawings in mind. The drawings are:

DETAILED DISCLOSURE OF THE ILLUSTRATIVE EMBODIMENTS

Figure 1:
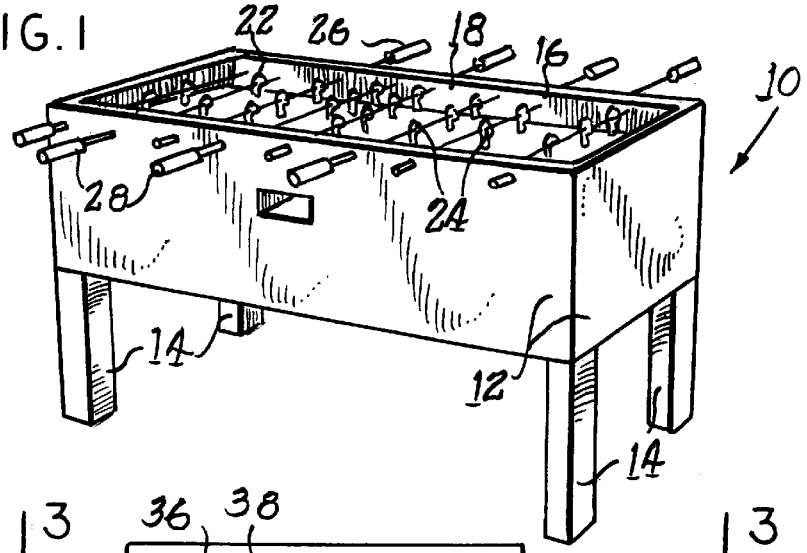
FIG. 1 is a perspective view of the apparatus for playing foosball.

Reference first should be had to FIG. 1 for a showing a foosball game table. The table is identified by numeral 10 and includes side and end walls 12 and four rectangular legs 14 depending from the side and end walls to support the table on the floor. There is an absolutely level playing field comprised of a single board laid across the side and end walls, and usually covered with felt of highest quality.

Four defensive rods 18 extend across the table and above the floor. Similarly, four offensive rods 20 extend across the table respectively fitting between the defensive rods 18 and coplanar therewith. The defensive rods 18 each carry five paddles 22, and in similar fashion the offensive rods carry five offensive paddles 24. There are operating handles 26 on the defensive handles outwardly of the side walls, and likewise there are operating handles 28 on the offensive rods. There are five defensive paddles 24 extending from the defensive rods down into proximity to the floor 16 of the rods, and there are five offensive paddles on each offensive rod. Respective rods are mounted for push-pull movement, and also for rotary movement in the side walls. That is to say, the offensive rods are mounted for a "kicking" attack on the ball anywhere on the floor, and similarly there are defensive paddles for kicking the ball in defense. A spherical ball of some weight is placed on the table for playing the game, and the offensive handles and rods are operated by a man on the offense, and the defensive rods and paddles are similarly handled by a defensive man.

A problem arises if one man wants to practice. He will generally practice on the offensive, but there is no one to practice on the defense. There are so many handles on the offensive rods, and a like number of handles on the defensive rods and they cannot all be handled by one man. Accordingly, I have provided means for operating the defensive rods either mechanically or electrically, and this comprises my invention.

Figure 2:
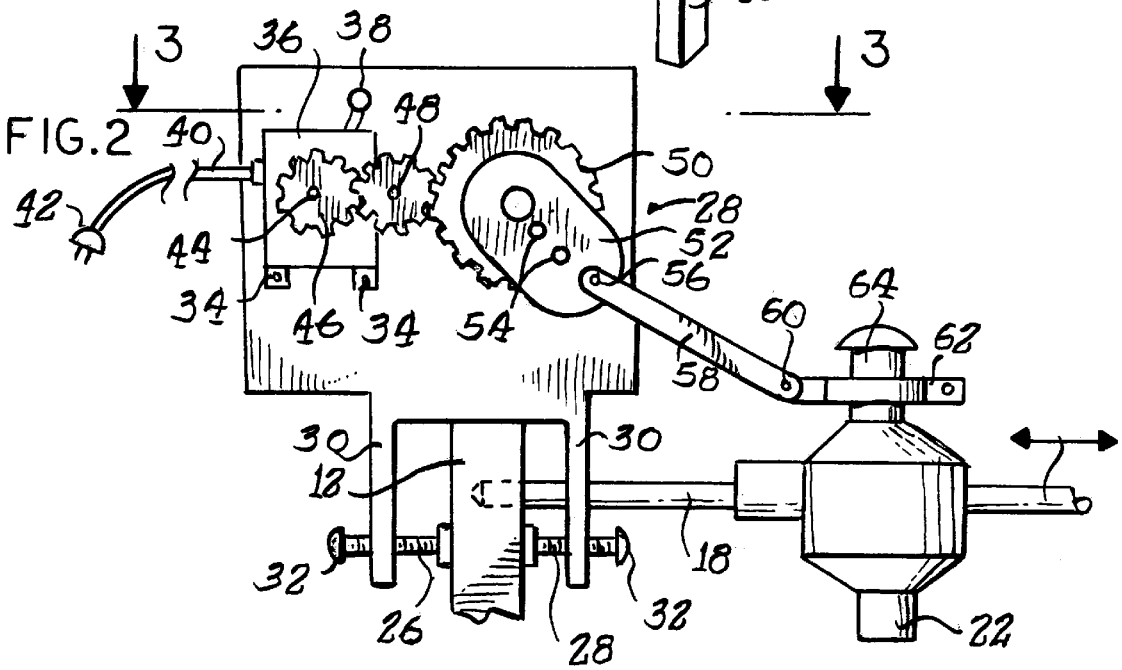
FIG. 2 is a view taken in one direction of the adaptation for playing the defense.
Figure 3:
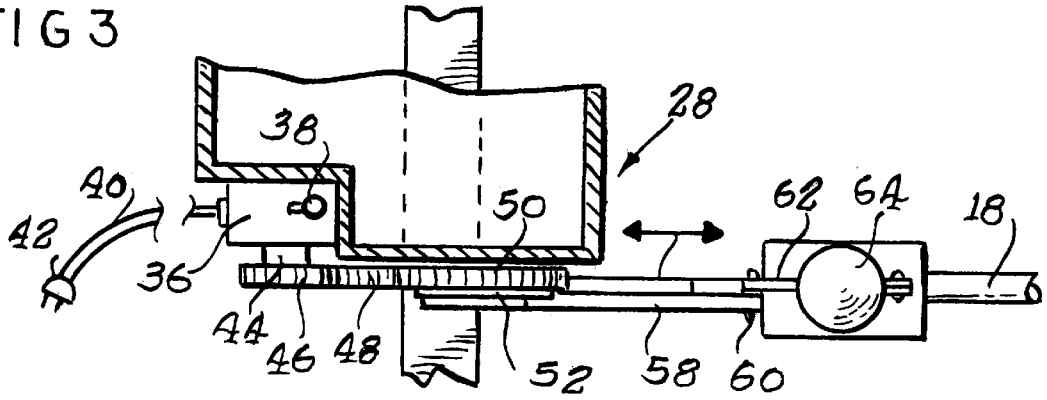
FIG. 3 is a partially sectional view taken substantially along the line 3—3 in FIG. 2.

My invention is illustrated in its simplest form in FIGS. 2 and 3. In its simplest form the invention simply holds the defensive paddles on one rod down toward the playing field. It moves the rod back and forth to set up a moving defense. This is done by means of a mounting plate or box 29 which is mounted, for example, on the side plate 12 of the game housing which is perpendicular to a defensive rod 18. The mounting is by means of a pair of set screws 32 mounted in depending arms 30 on the plate or box 29, each set screw 32 having a finger piece for adjusting the position of the box toward and away from the rod 18 chosen to be the one of the defensive control. A motor box 39 is mounted on the plate 29 by means of a pair of right angle tabs and penetrating screws 34. The motor box 36 has a thumb piece 38 mounted for turning the motor box on and off, and a flexible extension cord 40 having a polarized two or three prong plug 42 mounted on the end extends from the motor box.

What is not shown is the insides of the box, which comprises a conventional circuit for converting the alternating current appearing in the cord 40 to direct current. The direct current drives a motor having a shaft 44 with a gear 46 on the outside of the box 36. The gear drives a idler gear 48 which in turn drives a control gear 50 having an operating arm 52, fixed on the gear by conventional means such as screws 54.

The arm 54 has an eccentric pivot 56 mounted thereon driving a connecting rod 58. The connected rod in turn has a pivot 60 at the end thereof, and this pivot drives a clamp 62 clamped about the upstanding neck 64 on a fitting clamped to the defensive rod 18, and carrying the defensive paddle.

When the plug 42 is plugged into a wall outlet, and the switch operator moves the arm 38 to the "on" position, the motor having the shaft 44 will run. This drives the gear train, and the gear train in turn drives the arm 52 pivoted to the connecting rod 56. The connecting rod is connected to the clamp 62, and drives the arm 18. This moves the rod 18 back and forth, and it can be stopped in any desired position with the paddles in fixed position in a defensive set up. Alternatively, the paddles can be kept removing, and will move back and forth in defensive position.

Figure 4:
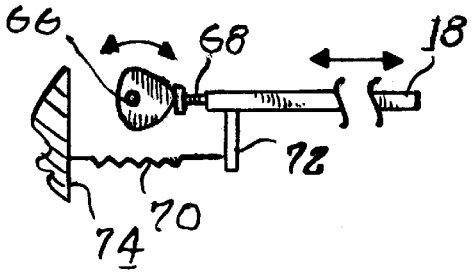
FIG. 4 is an illustration of a defense in the game showing one variation.

The defensive system as so far shown and described results in either a fixed or a movable defensive system, and is not too difficult for the player to operate, while operating the offensive system. Nevertheless, it can give the player worthwhile practice in playing the game. If he wants a somewhat more sophisticated defense, he will turn to the form of the invention shown in FIG. 4, wherein an eccentric cam 66 is driven by an electric motor, such as the motor that drives the shaft 44. The cam bears against the head 68 of a screw threaded into the end of the rod 18. A spring 70 stretched between a pin 72 threaded into the side of the rod 18, and a fixed pin 74 holds the screw head 64 against the cam. The cam moves the rod back and forth in accordance with the movement of the cam 66. It is thus somewhat more difficult for the player to judge the position of the paddles when the rod 18 is stopped.

Figure 5:
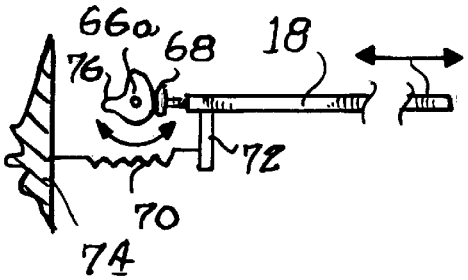
FIG. 5 is a variation on FIG. 4.

A somewhat more complicated cam is shown in the embodiment of FIG. 5, thus making it more difficult for the player to learn the positions of the paddles when stopped. The parts are the same as in FIG. 5, except that the cam 66*a* will provide a resting place for the rod 18, followed by a jerk movement to a different position, followed by a rapid movement away from the resting place when the finger 76 on the cam is encountered, followed by another drop away, a fixed resting place, and another rest for the rod. This is a somewhat improved form of defense.

Figure 6:
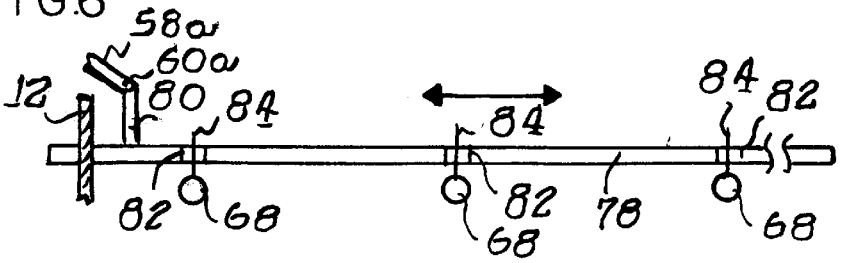
FIG. 6 shows another variation on the defense.

A further modification of the invention as shown in FIG. 6 provides for rocking of the rod, and can be combined with any of the first three forms to produce a very complicated movement. A rod 78 is arranged for reciprocating movement through holes in a pair of end boards 12 of the cabinet. The rod is driven by a mechanism as described in FIGS. 2 and 3, and the rod 58*a* drives a fixed pin 80 in the rod 78. A motor and gears are respectively mounted at right angles to the position shown in FIGS. 2 and 3, and the rod is thus moved back and forth in a path parallel to the long dimension of the game. Holes 82 are provided in the rod 78, and pins 84 in the rods 18 extend through these holes. The arrangement is such as to provide a 90° rocking movement to all of the defensive rods 18, thus moving the paddles from rest up to horizontal and back. This provides a different movement than has been used heretofore, namely flipping of the paddles, rather than just moving the paddles from side to side. Embodiments may be combined to produce desired movements.

Figure 7:
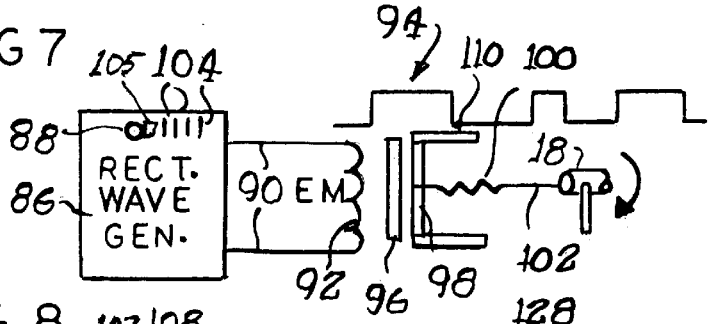
FIG. 7 is a plan view of a modification providing complete defense.
Figure 8:
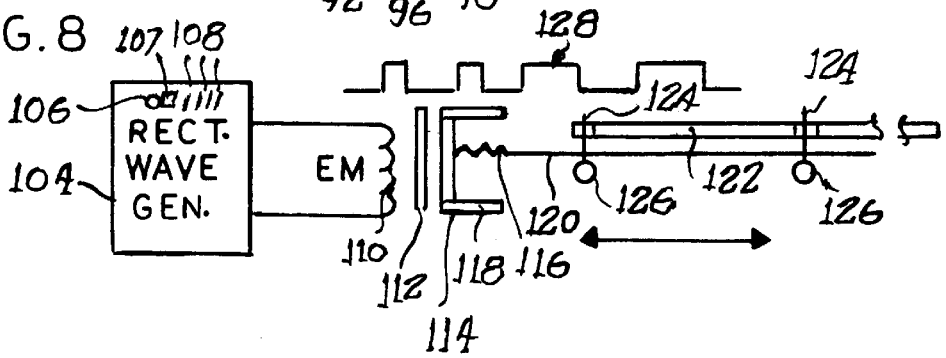

In FIG. 7 I have disclosed an advanced embodiment of the invention further to test the skills of the player. This embodiment of the invention will provide coordinated movements of the rods in any desired pattern. A first box 86 includes a rectifier of conventional design, a knob 88 for turning the generator and other things in the box off and on and a pair of output wires 90. The wires are connected to an electromagnet 92, and the motor may be connected to produce an output wave which is shown at 94. In its simplest form, the motor may control a cam opening and closing a switch. When the switch is closed, the wave remains high, and when it is open, the wave is low.

The output wave controls currents through the input coil of an electromagnet including the coil 92 and this energizes an iron core 96. The core periodically attracts an iron core 98 when the wave is high, and releases it for a spring to pull the core 98 making it pull the spring 100 (to the left in the position as shown in the diagram). The core is moved back to its limit at the left in non-magnetic cylinder 110 when the wave 94 is at 0 and the core is connected by a non-magnetic strand 102 to a selected rod 18 to move it back and forth in an endwise direction in cooperation with a spring. Four switches 104 are connected in the box 86 to independently control the four electromagnets 92 to provide selective control of the four defensive mechanisms. Switch 105 controls the length of the oscillations in waveshape 94.

A second control box 104 is provided, and it may include everything that is in the control box 88. Thus, it may include a control switch 106, switch 107 to control the length of waves, and four branch switches 108 to individual electromagnets 110, and a switch 109 to control the shape of the wave. Each of the electromagnets 110 has an electromagnetic core 112. An attracted core 114 moves back and forth under the joint control of the core 112 and a spring 116. The core moves within a non-magnetic cylinder 118 back and forth between the influence of the core and the spring. The core is connected by a non-magnetic strand 120 to control the back and forth movement of a rod arranged to run longitudinally of the game, and operating pins 124 driven into the rods 126, and thus to rock all of the pins connected to the rod. The wave 128 for the electromagnet is shown, and it will be seen that it varies on a different pattern than the first wave 94. The individual switches 108 allow one or more of the control rods to be connected to rotate, and with such rods can be controlled to rock as desired. With the two electronic boxes, the rods in the foosball game can be made to move both longitudinally and with a rocking movement in any desired patter Thus I have expanded the original form of the invention to provide any desired control over the various rods. The rods can be individually controlled to slide to left and right, and in any individual pattern to rock to prevent the game player from knocking the ball into a goal at the end of the game. Thus, the individual can practice against any form of defense imaginable, even though he is the only one present to operate the machine.

I have shown various embodiments that operate to provide such control Various changes in structure will no doubt occur to those skilled in the art, and such changes will be deemed a part of the present invention insofar as they fall within the spirit and scope of the appended claims.

What is claimed is:

1. A soccer board game comprising an offensive playing horizontal rod having paddles thereon and movable to knock a ball toward an offensive goal, interspersed defensive rods comprising spaced among the offensive rods and having paddles thereon for keeping said ball from said goal, manually movable means for moving said defensive rods longitudinally to move said defensive paddles relative to the game board, and electrically mounted means to electrically operate at least one of said rods longitudinally to vary the defensive set-up so that the same player can play offensively to advance said game and simultaneously to hinder advancing the offensive game.

2. The soccer board game as set forth in claim 1, and means for adjusting the mounting of the electrically mounted means.

3. The soccer board game as set forth in claim 2 wherein the electrically operated means includes a motor, a connecting rod connected to said motor by gear means, and an eccentric pin moved by one of said gear means, and which is connected to said connecting rod.

4. The soccer board game as set forth in claim 3, and means for adjusting the position of said electrically operated means.

5. The soccer board game as set forth in claim 1, and further including means for rocking said defensive rods.

6. The soccer board game as set forth in claim 1 wherein said defensive rods are movable both longitudinal and with a rocking movement.

7. A soccer board game as set forth in claim 1 wherein a cam is included in said electrically operating means.

8. A soccer board game as set forth in claim 7 wherein the cam is of variable shape.

9. A soccer board game wherein the electrically operating means as set forth in claim 1 includes electromagnetic means for varying the defense.

10. A soccer board game as set forth in claim 9 wherein the cam is connected to at least one of the defensive rods.

11. A soccer board game as set forth in claim 9 wherein the electrically operated means includes means for generating a rectangular wave.

12. A soccer board game as set forth in claim 11 wherein there is included a means for varying said rectangular wave.

13. A soccer board game as set forth in claim 9 wherein there is means for connecting said electrically operated means to said defensive rods for movement of said rods both rotationally and longitudinally.

* * * * *